US005788295A

United States Patent [19]

Fuss et al.

[11] Patent Number: 5,788,295

[45] Date of Patent: Aug. 4, 1998

[54] ELECTRIC DOOR OPENER WITH MULTIPLE POSITION ARMATURE PERMITTING DIFFERENT OPERATION MODES

[75] Inventors: Fritz Helmut Fuss; Michael Holzer, both of Albstadt, Germany

[73] Assignee: eff-eff Fritz Fuss GmbH & Co. Kommandit-gesellschaft auf Aktien, Albstadt-Ebingen, Germany

[21] Appl. No.: 808,161

[22] Filed: Feb. 28, 1997

[30] Foreign Application Priority Data

Feb. 29, 1996 [DE] Germany ..... 196 07 684.6

[51] Int. Cl.[6] ..... E05B 15/02

[52] U.S. Cl. ..... 292/341.16

[58] Field of Search ..... 292/251.5, 341.16, 292/244

[56] References Cited

U.S. PATENT DOCUMENTS

| | | | |
|---|---|---|---|
| 3,910,617 | 10/1975 | Scalza | 292/341.16 |
| 4,015,869 | 4/1977 | Horvath | 292/341.16 |
| 4,756,566 | 7/1988 | Logas | 292/341.16 |
| 4,838,591 | 6/1989 | Fuss | 292/341.16 |
| 5,439,262 | 8/1995 | Fuss et al. . | |
| 5,490,699 | 2/1996 | Uyeda | 292/341.16 |

*Primary Examiner*—Flemming Saether

*Attorney, Agent, or Firm*—Oblon, Spivak, McClelland, Maier & Neustadt, P.C.

[57] ABSTRACT

An electric door opener with a trimmer actuatable by an armature and a magnet coil. The trimmer is adjustably positioned for the release or locking of a door opener latch. The door opener is useable as an electric no-load current door opener and as an operating current door opener because a selector device is provided to switch the armature-trimmer system between no-load current movement positions and operating current movement position.

9 Claims, 3 Drawing Sheets

ELECTRIC DOOR OPENER WITH MULTIPLE POSITION ARMATURE PERMITTING DIFFERENT OPERATION MODES

BACKGROUND OF THE INVENTION

1. Field of the Invention

The invention relates to an electric door opener with a trimmer subject to the action of an armature and a magnet coil and which is adjustably positioned for releasing or locking a door opener latch.

2. Description of the Related Art

A door opener with a trimmer is disclosed in EP 279 878 A1. The function of this electric door opener is based on the fact that the trimmer is held by an armature in the swivelling area of a door opener latch until the armature releases the trimmer by the operation of a magnet coil. With the aid of a trimmer spring the trimmer is brought out of the swivelling range of the door opener latch.

A distinction exists between two types of electric door openers, i.e., between an operating current design and a no-load current design. In an operating current design the armature is operated by energizing the magnet coil counter to the bias of the armature spring, whereas a door opener having a non-load current design can only be opened when the current is disconnected. If a no-load current door opener is energized, locking takes place.

Hitherto it was necessary to provide and keep available two different basic constructions for these two electric door opener types, leading to increased costs, particularly those involved in the storage of the two types.

SUMMARY OF THE INVENTION

One object of the invention is to provide an electric door opener which, without significant extra cost, can be used both as an operating current door opener and as a non-load current door opener.

According to the invention, this object is achieved in the case of an electric door opener with a trimmer actuatable by an armature and a magnet coil and which is adjustably arranged for the release or locking of a door opener latch, in that a device is provided for the, as desired, type switching between the no-load and operating current type by means of an armature travel determining device permitting different armature movement to provide both types of door openers.

Another object of the invention is to provide a switchable door opener, which, in an extremely short time, can be converted from a no-load current design into an operating current design and vice versa. For this purpose a device is provided which can be quickly and easily manipulated to switch between the no-load current and operating current types.

Yet another object of the invention is to reduce costs because only a single door opener design has to be manufactured and stored, where this door opener can be converted for use in accordance with the particular needs for an operating current type door opener or a no-load current type door opener. Furthermore, such a switchable electric door opener has a higher use value due to the possibility of use as either of these two types of door openers.

Still another object of the invention is to associate with the known two positions (locked-unlocked) armature three positions, namely unlocked-locked-unlocked. The construction according to the invention can also be varied so that the positions would be locked-unlocked-locked.

According to the invention, on the basis of a three position armature, a no-load current-operating current switching takes place, in that the first or last position of the armature is disabled or inhibited for the same, i.e. as a function of the construction one of the two "unlocked" positions or one of the two "locked" positions.

Whereas an armature without disabling can assume three basic positions, namely unlocked-locked-unlocked, e.g., for the no-load current design the first position is disabled. This then gives the basic positions disabled-locked-unlocked.

For an operating current door opener the last unlocked position is disabled, so that the positions unlocked-locked-disabled can be assumed.

A disabling of the corresponding basic positions can be achieved with different constructions.

In a preferred, particularly simple and efficient construction use is made of a device, which cooperates with the armature and the trimmer. By an adjustment of this device, which can be carried out without any time and tool expenditure, two positions (locked-unlocked or unlocked-locked) are chosen from the three possible positions (locked-unlocked-locked).

In a preferred embodiment the selection device is constructed as a rotation stop, which is adjustable about a rotation axis parallel to the swivel axis of the trimmer and the armature. This rotation stop can, e.g., be adjusted or rotated with the aid of a commercial screwdriver, so as to be able to obtain both an operating current position and a no-load current position.

In an appropriate construction the rotation stop is an almost circular disk, which has at least one means with which it can be held in the necessary two positions in or on the casing of the electric door opener. Therefore the rotation stop is provided with a stop for its rotary movements and cannot be rotated further than is in each case intended.

Advantageously a catch element can be constructed on the rotation stop and can engage in a complimentary recess for a no-load current position in the, casing or on the base plate or in a recess for an operating current position. If a catch nose is provided on the rotation stop circumference, notches can be constructed in the casing as recesses. It is also possible to provide a catch pin connected in non-rotary manner with the rotation stop and which is adjustably held in at least two positions.

The necessary positions of the armature cooperating with the trimmer, said armature being positioned above the rotation stop and adjustable about a vertical swivel axis, are made possible with the aid of shaped parts, e.g., virtually circular sector-like lugs on the almost circular, disk-like rotation stop.

These lugs on the surface of the rotation stop cooperate with a correspondingly constructed armature and a trimmer head in such a way that of the three possible basic positions of the armature, only the first or third unlocked position is disabled.

In place of a rotation stop it is also possible to use other constructions for disabling these unlocked positions. For example, it is possible to introduce a threaded pin as a disabling element through the base plate or the casing in order to disable the corresponding position.

However, the rotation stop in the described construction gives rise to advantages as regards manufacture and installation, together with an extremely high reliability in use.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
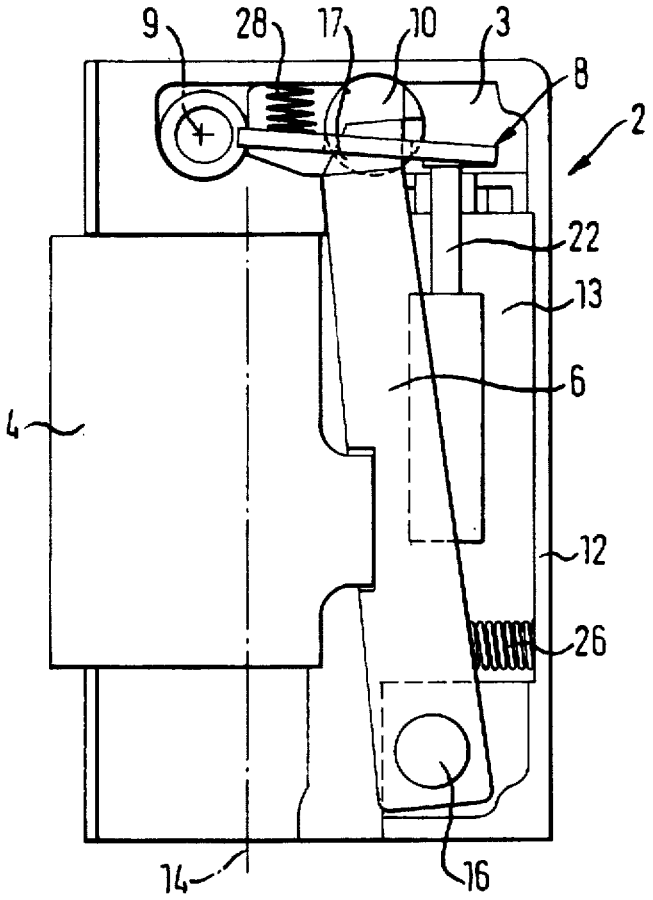
FIG. 1 is a side view of a door opener according to the invention with the casing cover removed.

Referring now to the drawings, wherein like reference numerals designate identical or corresponding parts throughout the several views, it is noted that in order to facilitate understanding only those door opener parts are shown and described, which are directly linked with the construction according to the invention.

FIG. 1, which shows an electronic door opener 2 inside view with a door opener latch 4 deflectably mounted in known manner about a swivel axis 14 in the drawing plane. The door opener latch 4 is subject to the action of a trimmer 6, whose swivel axis 16 is perpendicular to the drawing plane. The trimmer 6 is biased against the door opener latch 4 by a trimmer spring 26, which is supported against a door opener casing 12.

Figure 2:
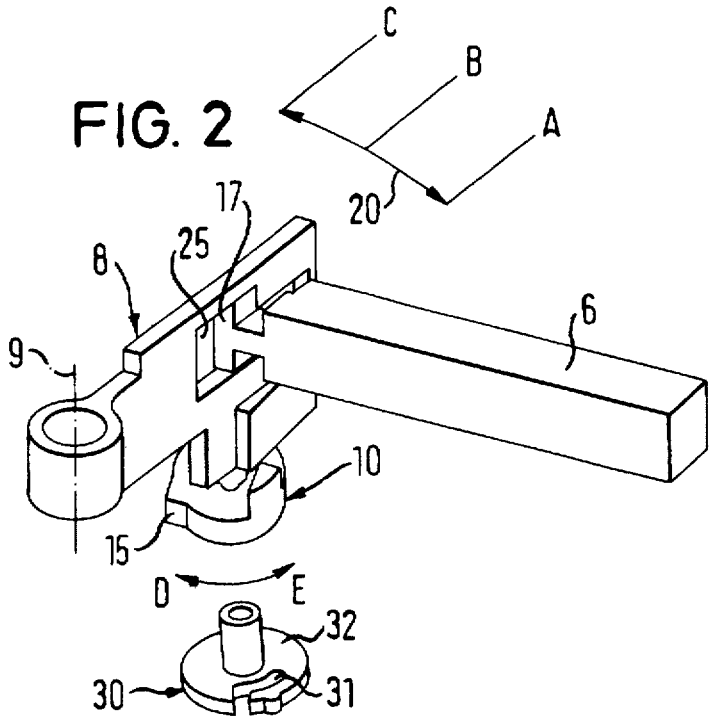
FIG. 2 is a perspective view of an embodiment of a functional unit comprising rotation stop, armature and trimmer.

The trimmer 6 is disabled or released by an armature 8, which is constructed in rocking lever-like manner and has a recess 25 for receiving a trimmer head 17, as illustrated in FIG. 2.

In the present embodiment, a magnet coil 13 is located to the right of the armature 8. On energizing the magnet coil 13 a coil core 22 coming out of the coil 13 forces the armature 8 into position B or C which are indicated in FIG. 2.

It is also possible to position the magnet coil to pull instead of push the armature, so that the armature moves against an opposing armature.

The armature 8 according to FIG. 1 is adjustably mounted about a swivel axis 9, which is parallel to the swivel axis 16 of the trimmer 6 and is urged into the position shown by an armature spring 28, which is fixed to the door opener casing 12.

A rotation stop 10, which is located below the recess 25 of the armature 8 for the trimmer head 17, as shown in FIG. 2, is used for converting or switching the electric door opener from a no-load current door opener to an operating current door opener and vice versa.

The essential construction parts for a switchable no-load-operating current door opener are shown in FIG. 2. The trimmer 6, which locks or unlocks a door opener latch 4 according to FIG. 1, cooperates with an armature 8, which is moved by a magnet coil 13 (FIG. 1) and is limited in a defined manner in its swivelling movement about an axis 9 by a rotation stop 10.

Whereas in the hitherto known electric door opener constructions an armature can only implement two positions, namely unlocked or locked, the armature 8 according to FIG. 2 permits three positions: unlocked A—locked B—unlocked C.

A no-load-operating current switching is achieved based upon which of unlocked position A or unlocked position C is disabled or inhibited. For a no-load current door opener the first unlocked position A and for an operating current door opener the second unlocked position C is disabled or inhibited.

As shown in FIG. 1, the armature 8 is forced in one direction by an armature spring 28 and is moved in the opposite direction by the operation of a magnet coil 13 having a coil core 22.

The disabling of the unlocked positions A and C are achieved by the rotation stop 10 in a particularly effective and reliable manner.

The rotation stop 10, which can, e.g., be fixed to a base plate 3 of the electric door opener 2 (FIG. 1), is adjustable about a rotation axis 11 from a position D into a position E. A fixing in the position D or E can be brought about by a shaped part 15 which in the present embodiment appears as an approximately triangular catch nose 15 on the circumference of the almost circular rotation stop 10.

The catch element 15 cooperates with complementary constructed recesses which are not shown. These recesses are provided with a clearly defined spacing as a no-load current notch and as an operating current notch, which notches are in or on the door opener casing 12. The rotation stop 10 can then be rotated with a normal, commercial screwdriver that will engage the catch nose 15 in the no-load current notch or in the operating current notch.

In an advantageous development, the rotation stop 10 is connected in nonrotary manner to a catch pin 30 and its rotary movement D-E is limited by means of a slotted hole 31 in a disk-shaped part 32 of the catch pin 30 and an engagement element (not shown) cooperating with said slotted hole 31 on the casing 12 or on the base plate 3.

On the surface of the rotation stop 10 are provided two lug-like elements 19 for limiting the swivelling movement of the armature 8, which is constructed in swivel clip-like manner.

Figure 3:
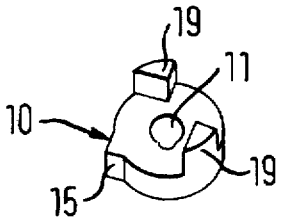
FIG. 3 is a perspective view of a rotation stop.

FIG. 3 shows the roughly circular sector-shaped construction of the lugs 19. These lugs 19 are constructed virtually diametrically to one another on the surface of the rotation stop 10 and cooperate with the armature 8. Wedge-shaped control surfaces 27 of the armature 8 are located in the action zone of the magnet coil 13 (FIG. 1).

An arrow 20 in FIG. 2 illustrates the swivelling movement of the armature 8 and the unlocking or locking positions with respect to the door opener latch 4 brought about by the trimmer 6 and particularly the trimmer head 17.

The switching positions reached by an almost T-shaped trimmer head 17 in vertical longitudinal section and a square recess 25 in the armature 8 are designated A, B and C. Of said three switching positions A, B and C, corresponding to unlocked—locked—unlocked, in each case an outer position, namely an unlocked position, is disabled with the aid of the rotation stop 10.

This disabling with respect to a no-load current door opener and an operating current door opener is described in conjunction with FIGS. 6 to 9.

Figure 4:
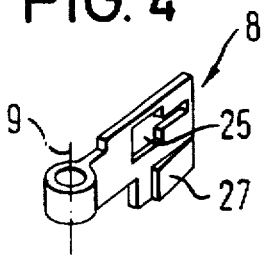
FIG. 4 is a perspective view of an armature.
Figure 5:
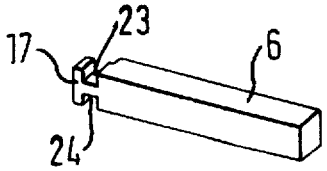
FIG. 5 is a perspective view of a trimmer.

FIG. 4 shows an armature 8 and FIG. 5 a trimmer 6. The trimmer head 17 with an upper, horizontal notch 23 and a lower, horizontal notch 24 cooperates with the recess 25 of the armature 8. Thus, the trimmer 6 has freedom of movement in the right-hand unlocked position A (FIG. 2).

Figure 6:
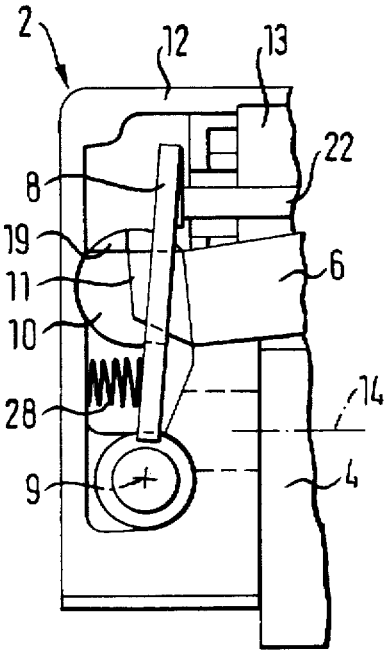
FIG. 6 is a partial side view of an electric no-load current door opener according to the invention and FIG. 2 in position A.
Figure 7:
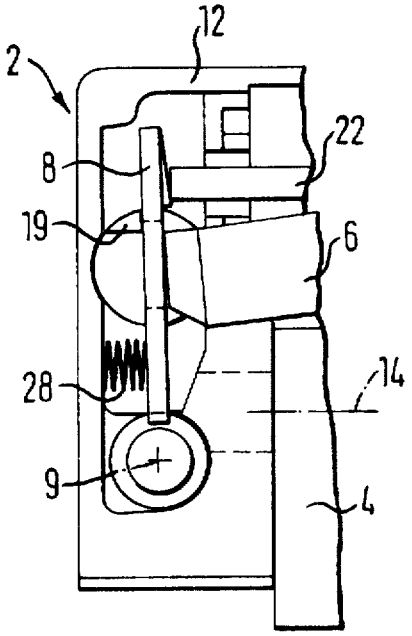
FIG. 7 is a partial side view of an electric no-load current door opener according to the invention and FIG. 2 in position B.

In FIGS. 6 and 7 the rotation stop 10 is in a no-load current position. In this view of a no-load current door opener 2 it is possible to see an unenergized coil core 22. Therefore, the armature 8 is forced to the right by the armature spring 28. This position corresponds to position A in FIG. 2 and means that the trimmer 6 maintains the door opener latch 4 in an unlocked position. With respect to the rotation stop 10 it is only possible to see an upper lug 19 which, as is apparent from FIG. 7, brings about a leftward limitation of the swivelling movement of the armature 8 following an energizing of the magnet coil 13. In FIG. 7 the armature 8 and trimmer 6 are in the central locked position B according to FIG. 2.

Figure 8:
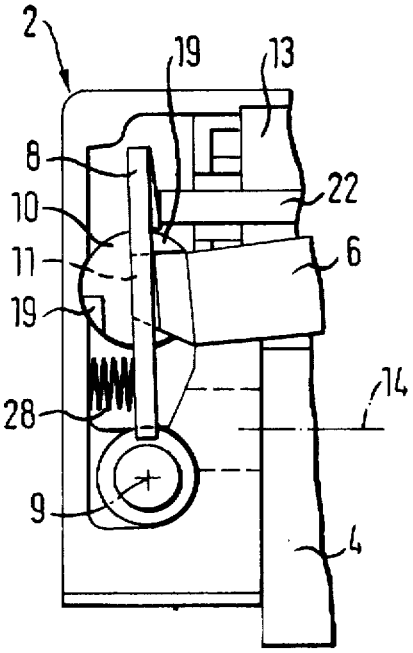
FIG. 8 is a partial side view of an electric operating current door opener according to the invention and FIG. 2 in position B.
Figure 9:
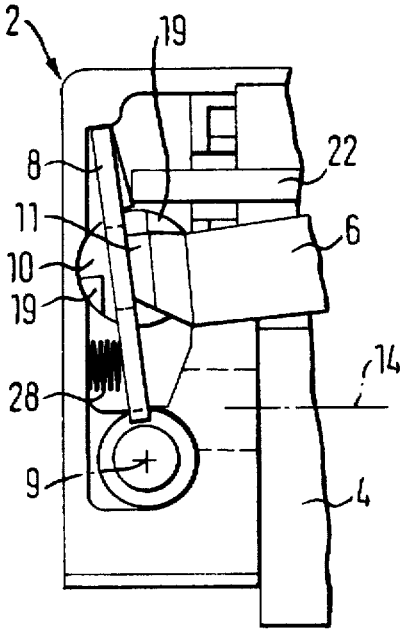
FIG. 9 is a partial side view of an electric operating current door opener according to the invention and FIG. 2 in position C.

FIGS. 8 and 9 show an electric door opener 2 of an operating current design. For implementing an operating current door opener, the rotation stop 10 has been rotated about its rotation axis 11 into the operating current position, which is made very clear from the modified position of the lugs 19 compared with the position of these lugs shown in FIGS. 6 and 7. FIG. 8 shows the magnet coil 13 in the de-energized state, so that the armature 8 is in the central position B according to FIG. 2. The trimmer 6 is held with its trimmer head 17 in the recess 25, so that the door opener latch 4 is locked.

Due to the energizing of the magnet coil 13 in FIG. 9, the armature 8 is moved by the coil core 22 into the left-hand unlocked position C according to FIG. 2, so that the trimmer 6 can slide past the armature 8 in the "opening" direction.

Obviously, numerous modifications and variations of the present invention are possible in light of the above teachings. It is therefore to be understood that within the scope of the appended claims, the invention may be practiced otherwise than as specifically described herein.

What is claimed as new and is desired to be secured by Letters Patent of the United States is:

1. An electric door opener comprising:

a door opener latch;

a trimmer movable relative to the door opener latch to a position permitting the door opener latch to operate and a position preventing door opener latch operation;

an armature cooperating with the trimmer, said armature having at least three fixed positions determined by a position selection device, wherein the three armature fixed positions each provide either of the trimmer position that will permit door opener latch operation or the trimmer position that will prevent door opener latch operation;

an electric coil responding to a current to cause armature movement between at least two of the three armature fixed positions; and wherein the at least two of the three armature fixed positions between which the armature is moved by the coil are selected by the position selection device to establish two predetermined modes of operation related to the energization of the coil, with one of the modes permitting the door opener latch to operate when current is supplied to said coil and with the other one of the modes preventing the door opener latch from operating when current is supplied to said coil.

2. The electric door opener of claim 1, wherein the three armature fixed positions correspond to positions for freeing or locking the trimmer and the door opener latch and the modes correspond to a no-load current mode and an operating current mode.

3. The electric door opener of claim 1, wherein the position selection device comprises a rotation stop adjustable about a rotation axis parallel to a swivel axis of the trimmer and a swivel axis of the armature.

4. The electric door opener of claim 3, wherein the rotation stop has a catch element and a door opener casing or a door opener base plate are provided with complementary recesses for alternately receiving the catch element.

5. The electric door opener of claim 4, wherein the catch element is on the circumference of the rotation stop and is alternately received in recesses provided in the door opener casing.

6. The electric door opener of claim 3, wherein the rotation stop is located below the armature and is provided with limiting elements which define the armature positions that can be selected.

7. The electric door opener of claim 6, wherein the limiting elements comprise lugs of a circular sector shape which are provided on the surface of the rotation stop.

8. The electric door opener of claim 1, wherein the armature comprises a rocker lever which has a recess for receiving a head of the trimmer.

9. The electric door opener of claim 8, wherein the head has a shape complementary to the shape of the recess and includes an upper horizontal notch and a lower horizontal notch.

* * * * *